US006952165B2

(12) United States Patent
Kovach et al.

(10) Patent No.: US 6,952,165 B2
(45) Date of Patent: Oct. 4, 2005

(54) CONCEALED WIRELESS SENSOR WITH EXTERNAL ANTENNA

(75) Inventors: John M Kovach, Shoreham, NY (US); Kenneth G Eskildsen, Great Neck, NY (US)

(73) Assignee: Honeywell International, Inc., Morristown, NJ (US)

( * ) Notice: Subject to any disclaimer, the term of this patent is extended or adjusted under 35 U.S.C. 154(b) by 101 days.

(21) Appl. No.: 10/742,503

(22) Filed: Dec. 19, 2003

(65) Prior Publication Data

US 2005/0134471 A1 Jun. 23, 2005

(51) Int. Cl.[7] ..... G08B 13/08

(52) U.S. Cl. ..... 340/545.1; 340/545.2; 340/539.1

(58) Field of Search ..... 340/539.1, 539.23, 340/539.3, 540, 541, 545.1, 545.2, 545.4, 545.5, 545.7, 547, 551, 566; 70/208

(56) References Cited

U.S. PATENT DOCUMENTS

| | | | | |
|---|---|---|---|---|
| 3,725,887 A | * | 4/1973 | Sneider | 340/539.3 |
| 5,164,705 A | | 11/1992 | Dunagan et al. | 340/547 |
| 5,512,874 A | * | 4/1996 | Poston | 340/426.26 |
| 5,970,393 A | | 10/1999 | Khorrami et al. | 455/129 |
| 6,157,344 A | | 12/2000 | Bateman et al. | 343/700 MS |
| 6,310,549 B1 | * | 10/2001 | Loftin et al. | 340/547 |
| 6,492,960 B2 | | 12/2002 | Sullivan | 343/895 |
| 6,684,671 B2 | * | 2/2004 | Beylotte et al. | 70/208 |
| 6,737,969 B2 | * | 5/2004 | Carlson et al. | 340/547 |
| 6,753,757 B1 | * | 6/2004 | Lerchner et al. | 340/5.6 |

OTHER PUBLICATIONS

Ademco 5800SS1 Wireless Shock Sensor Data Sheets, dated Feb. 2002.

* cited by examiner

*Primary Examiner*—Van T. Trieu
(74) *Attorney, Agent, or Firm*—Anthony R. Barkume, P.C.

(57) ABSTRACT

A wireless security device, such as a door or window motion sensor, that can be mounted almost entirely within a recess of a door, window or frame, with only the antenna mounted on the surface of the door or window jamb. The wireless security device has a housing suitable for being embedded within a structure such as a door, window or frame. In the housing are a security sensor circuit adapted to generate an alarm signal when activated, a radio frequency (RF) transmitter connected to the security sensor circuit for transmitting an RF signal when the alarm signal is generated, and a power source (such as a battery, piezoelectric element, solar cell or fuel cell) for supplying operating power to the security sensor circuit and the RF transmitter. A substantially flat surface mountable strip is located in proximity to the housing and is suitable for being mounted outside (i.e. along the surface of the structure). The surface mountable strip has an antenna that is coupled to the RF transmitter for emitting electromagnetic energy corresponding to the RF signal from the transmitter. In addition, the embedded antenna provides a predictable transmission pattern resulting in increased range and reliability.

46 Claims, 4 Drawing Sheets

CONCEALED WIRELESS SENSOR WITH EXTERNAL ANTENNA

BACKGROUND OF THE INVENTION

The present invention relates to security systems, and in particular to a wireless security device that may be embedded within a recess in a door or window with an externally located antenna for superior signal transmission performance.

Current door and window motion sensors are visible and thus detract from the decor of the premises. Embedding such devices typically will provide an inferior product since the RF transmissions are attenuated when the antenna is placed close to a printed circuit board and/or battery. Mounting the antenna on the PC board often causes the device to be too large to recess within a door or window.

SUMMARY OF THE INVENTION

The present invention is a wireless security device, such as a door or window motion sensor, that can be mounted almost entirely within a recess of a door, window or frame, with only the antenna mounted on the surface of the door or window jamb. The wireless security device has a housing suitable for being embedded within a structure such as a door, window or frame. In the housing are a security sensor circuit adapted to generate an alarm signal when activated, a radio frequency (RF) transmitter connected to the security sensor circuit for transmitting an RF signal when the alarm signal is generated, and a power source (such as a battery, piezoelectric element, solar cell or fuel cell) for supplying operating power to the security sensor circuit and the RF transmitter. A substantially flat surface mountable strip is located in proximity to the housing and is suitable for being mounted outside (i.e. along the surface of the structure). The surface mountable strip has an antenna that is coupled to the RF transmitter for emitting electromagnetic energy corresponding to the RF signal from the transmitter.

In one embodiment, the surface mountable strip is a plastic strip and the antenna is injection molded into the strip and electrically connected to the RF transmitter within the recessed housing. The shape of the housing is preferably cylindrical, and the surface mountable strip and housing form an integral assembly with the cylindrical housing being embedded in a hole bored into the mounting structure (e.g. the window) and the surface mountable strip forming a top circular portion that overlaps the hole and lays flat against the surface of the door or window jamb. Thus, the wireless security device is almost entirely recessed, with the antenna laying flat against the mounting surface. This provides for easy mounting of the security device within the window or like structure, and also provides the desired advantage of the antenna being externally mounted for better transmission and/or reception, due to being externally mounted and substantially isolated from the circuitry and power source within the housing. In addition, the present invention provides a more predictable antenna pattern than heretofore available under the prior art.

In an alternative embodiment, the surface mountable strip is physically discrete from the housing, and the antenna is printed onto the strip with conductive ink. A transfer coil is used to transduce the transmitted signal from the RF transmitter to the antenna (as an alternative to the direct wired connection in the first embodiment). This allows greater flexibility in sizing and placement of the antenna strip with respect to the embedded housing.

In either case, the surface mountable strip is thin enough to be located on a portion of a window or door that slides or closes with respect to a frame (or on the frame itself) without interfering with the operation of the door or window. The strip may be paintable and thus blend in with the decor of the premises.

DETAILED DESCRIPTION OF THE PREFERRED EMBODIMENT

Figure 1:
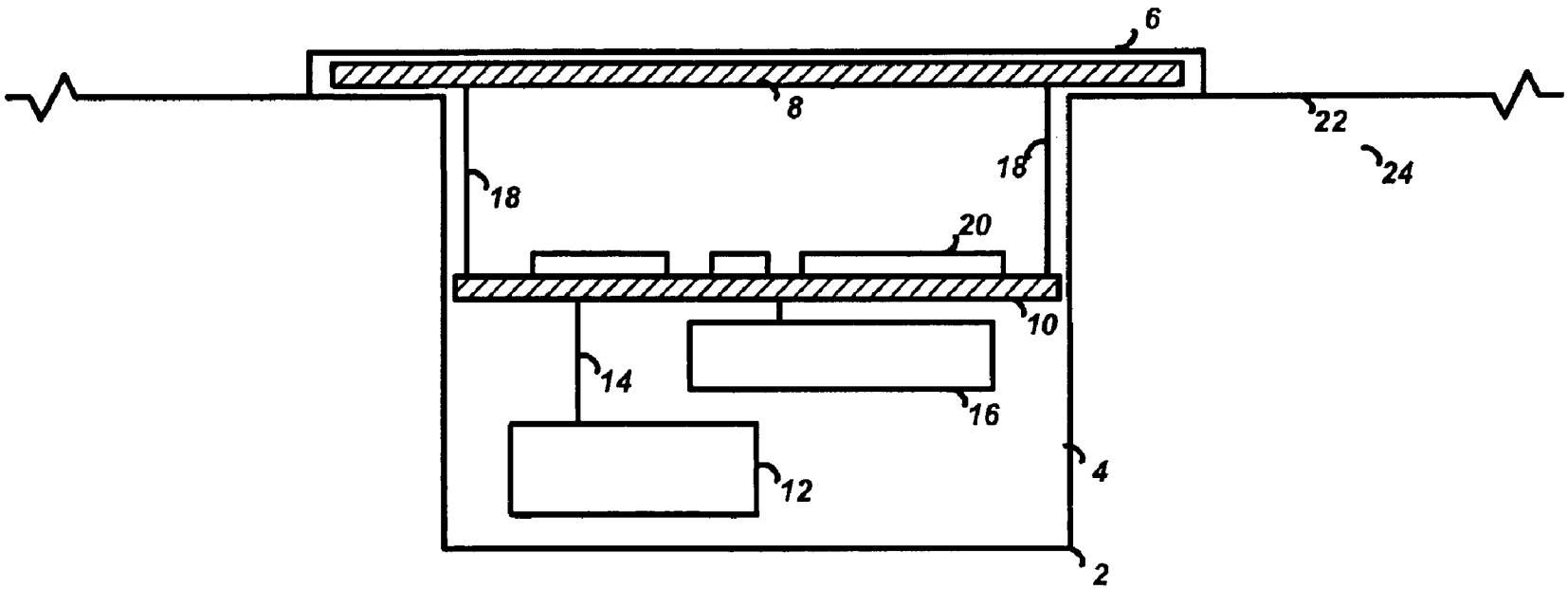
FIG. 1 is a side view cross-section of the preferred embodiment of the present invention.

The preferred embodiment of the present invention will now be described with respect to FIG. 1. Shown is a wireless security device 2 which has a cylindrical housing 4 and a surface mountable strip in the form of a round, substantially flat top portion 6. The housing is preferably cylindrical so that an installer can bore a hole within a structure 24 such as a window or door, and then easily insert the cylindrical housing into the hole. The housing may also be in other shapes, such as a rectangular prism, as desired by the designer. By making the top portion 6 longer in length than the housing, the top portion will rest easily against the surface 22 of the structure 24. The dimensions of the housing 4 and the hole may be configured so that the housing 4 will press fit snugly within the hole, or an adhesive may be used to provide for secure mounting. The top portion 6 is relatively thin, preferably on the order of approximately 0.050" thick, so that it lays substantially flat against the surface 22. This unobtrusive design allows placement of the wireless security device in a window or door without interfering with the movement of the window or door within the associated frame.

Within the housing 4 are three main components of the device, which are the power source 12 (such as a battery), a printed circuit board (PCB) 10, and a sensor device 16, which may be mounted to the PCB or which may be a discrete component within the housing 4. In any event the PCB 10 has mounted thereon the appropriate electronic circuitry 20 as required by the wireless security device as described herein.

For example, a typical device will include a radio frequency (RF) transmitter and control circuitry for detecting a change of state of the sensor device 16 and generating an alarm signal. The alarm signal is transmitted by the RF transmitter, via an antenna 8 as described below, to an RF receiver that is part of a security system installed in the premises, as well known in the art. The sensor device 16 may be any type of sensor that will indicate a state change when moved, such as (but not limited to) a magnetic field sensor (to sense the magnetic field of the Earth or of an externally located magnet), a gravitational field sensor, or a tilt switch. Each of these types of sensors are self-contained single-piece devices that do not require any other parts located external to the housing in order to sense movement of the housing. In the alternative, a two-piece sensor device may be used, although this would provide for a more complicated installation. For example, a magnetic reed switch may be used, where the housing encloses the reed switch and a magnetic actuator is located externally, typically on the opposing frame, jamb or surface of the window or door secured by the device.

Figure 3:
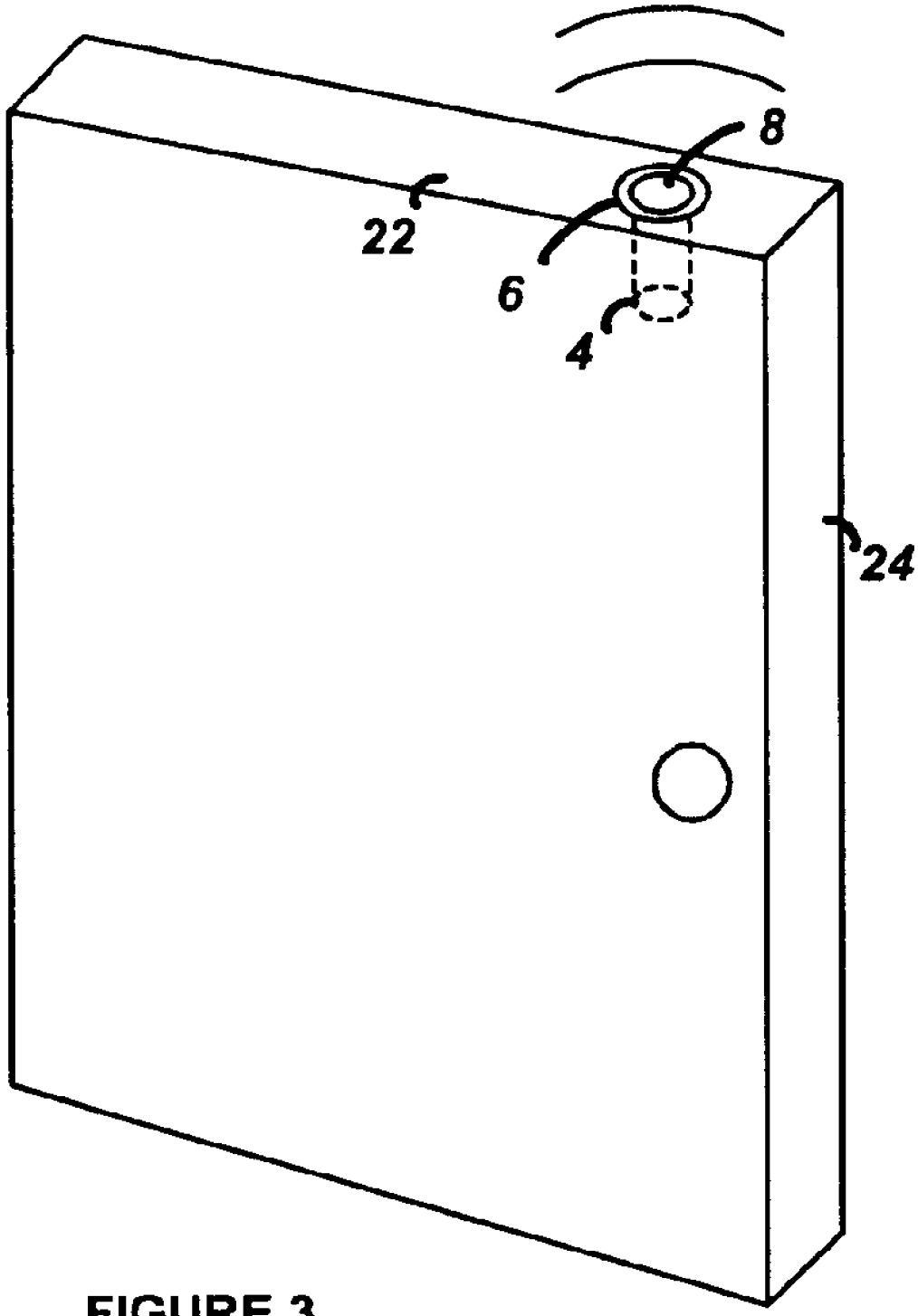
FIG. 3 is an illustration of the present invention installed in a door.
Figure 4:
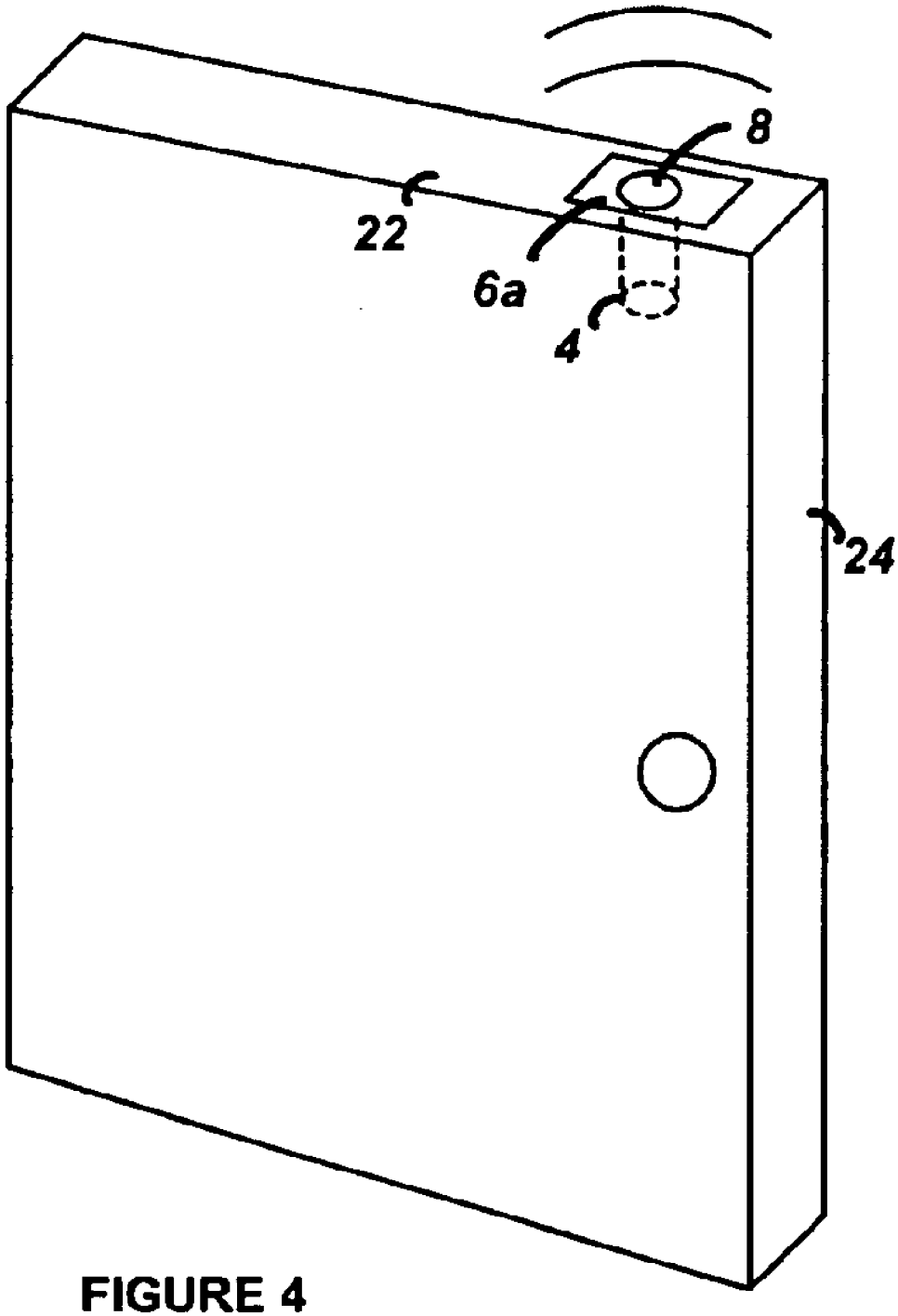
FIG. 4 is an illustration of an alternative embodiment of the present invention installed in a door.

FIG. 3 illustrates the mounting of the device 2 in a door 24. The housing 4 is seen embedded within the door 24, and the top portion 6, which is round, rests against the top 22 of the door 24 with a profile low enough to enable the door to easily fit within the door jamb (not shown) when it is closed. As such, the antenna 8 may transmit RF signals to the control panel of the associated alarm system via an RF receiver as well known in the art of security systems. FIG. 4 illustrates the same device with a rectangular shaped top portion 6*a* and antenna 8, which may be used if desired by the device designer. Virtually any shape may be used for the top portion as long as it fits on top of the door without interfering with its operation.

When the sensor 16 is triggered by movement of the door or window, then an alarm signal is generated by the control circuitry as well known in the art and provided to the RF transmitter for transmission to the control panel of the security system. An RF alarm signal is generated and provided to the antenna 8, which is embedded within the top portion 6, via conductors 18 (e.g. wires). The antenna 8 is configured to provide optimal signal transmission for a given application. For example, in the preferred embodiment, the antenna is an 8.56" wire length in a diamond configuration which is optimal for transmitting the RF signal (at frequencies between 345 MHz to 868 MHz).

As shown in FIG. 1, the power source and PCB are preferably separated from the antenna by a distance of approximately ¼" to ⅜". This isolation provides superior signal transmission, since the power source and circuitry on the PCB will interfere with the signal transmission much less than if the antenna were included within the housing. Thus, the present invention provides better signal transmission performance with an embedded device having a low profile external antenna.

As shown in FIG. 1, the top portion 6 preferably overlaps the housing 4 to provide for an easier installation. That is, the length of the opening into which the housing 4 is placed need not be made to the exact length of the housing since the top portion 6 will rest against the top of the door when inserted into the opening, even if the opening is longer than the length of the housing 4. Alternatively, the top portion 6 may be made to not overlap the housing if the design of the antenna 8 permits a smaller profile.

In this embodiment, the antenna 8 is made from copper wire. The antenna is integrated into the top portion 6 of the housing by an injection molding process known in the art.

Figure 2:
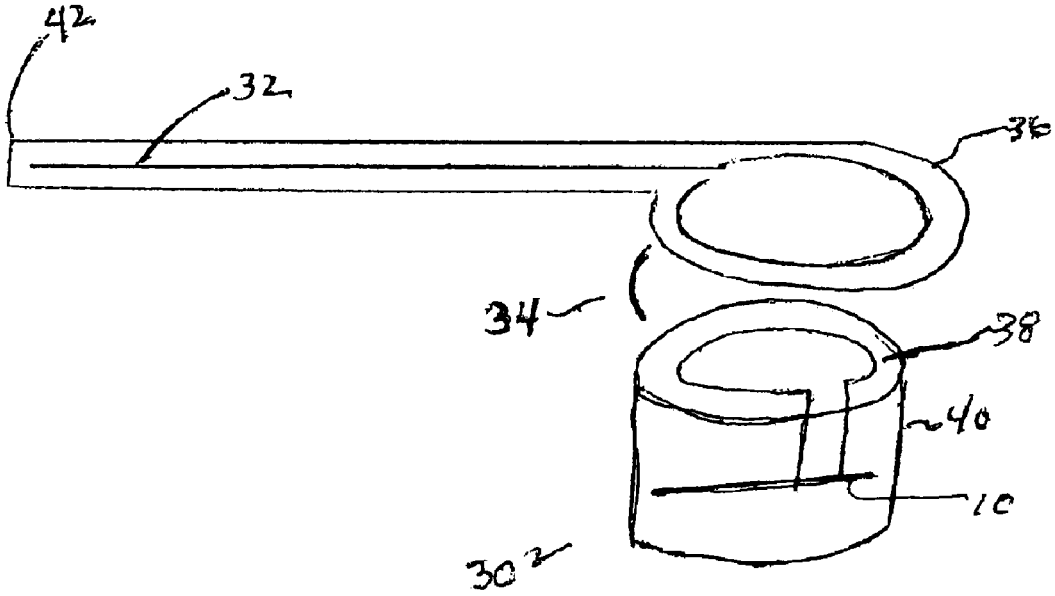
FIG. 2 is an illustration of an alternative embodiment of the present invention.

In an alternative embodiment shown in FIG. 2, the device 30 has an antenna 32 that is not wired directly to the RF transmitter, but instead is coupled electromagnetically by means of an RF air core transformer 34. The RF air core transformer 34 is comprised of conductive ink 36 that forms one loop of the transformer 34 and an injection molded antenna 38 in the housing 40 that forms the second part of the transformer 34. In this alternative embodiment, the antenna 32 is formed of conductive ink on a clear polycarbonate strip 42. By providing this two-piece device, the housing may be embedded within the recess of the desired structure, and the antenna may be located nearby as required by the installer. Thus, there is more flexibility in locating the antenna strip on the surface of the structure. The antenna strip 42 may be made from various shapes and sizes, depending on the needs of the installer. The antenna may be arranged in various manners so as to provide optimal signal transference between the RF transmitter and the security system RF receiver. An adhesive is placed on the bottom side of the strip 42 for easy mounting to the desired surface.

In the preferred embodiment, the length of the antenna is determined by the wavelength $\lambda$ of the signal being transmitted or a fraction thereof ($\lambda/8$, $\lambda/4$, etc.) For example, where $\lambda=c/f$, then $\lambda=(3\times10^8\ \text{m/s})/(345\ \text{MHz})=34.235$ inches or a fraction thereof as previously denoted.

What is claimed is:

1. A wireless security device comprising:

a. a housing suitable for being embedded within a structure comprising:

i. a security sensor circuit adapted to generate an alarm signal when activated;

ii. a radio frequency transmitter connected to the security sensor circuit for transmitting a radio frequency signal when the alarm signal is generated; and iii. a power source for supplying operating power to the security sensor circuit and the radio frequency transmitter; and b. a substantially flat surface mountable strip located in proximity to the housing and suitable for being mounted outside the structure, comprising an antenna coupled to the radio frequency transmitter for emitting electromagnetic energy corresponding to the radio frequency signal.

2. The device of claim 1 wherein the antenna is coupled to the radio frequency transmitter by a wired connection.

3. The device of claim 1 wherein the antenna is coupled to the radio frequency transmitter by electromagnetic energy.

4. The device of claim 1 wherein the surface mountable strip is integrally attached to the housing to form a unitary component, whereby when the housing is recessed within a structure, the surface mountable strip is mounted along the surface of the structure.

5. The device of claim 4 wherein the housing is cylindrical in shape.

6. The device of claim 4 wherein the housing is rectangular in shape.

7. The device of claim 5 wherein the surface mountable strip is substantially circular in shape and has a diameter larger than the diameter of the cylinder.

8. The device of claim 5 wherein the surface mountable strip is substantially rectangular in shape and has an area larger than the area formed by the top of the embedded housing.

9. The device of claim 5 wherein the surface mountable strip is substantially cylindrical in shape and has an area larger than the area formed by the top of the embedded housing.

10. The device of claim 1 wherein the surface mountable strip is plastic.

11. The device of claim 10 wherein the antenna is injection molded into the surface mountable strip.

12. The device of claim 1 wherein the antenna is formed of conductive ink printed onto the surface mountable strip.

13. The device of claim 12 further comprising a transfer coil for transducing the radio frequency signal from the radio frequency transmitter to the antenna.

14. The device of claim 1 wherein the security sensor circuit, the radio frequency transmitter, and the power source are located in substantial isolation from the antenna.

15. The device of claim 1 wherein the housing comprises a printed circuit board, and wherein the radio frequency transmitter is mounted on the printed circuit board.

16. The device of claim 15 wherein the security sensor circuit is mounted on the printed circuit board.

17. The device of claim 1 wherein the security sensor circuit comprises a tilt switch for generating the alarm signal when the housing is moved.

18. The device of claim 1 wherein the security sensor circuit comprises a magnetic field sensor for generating the alarm signal when the housing is moved relative to the earth's magnetic field.

19. The device of claim 1 wherein the security sensor circuit comprises a magnetic field sensor for generating the alarm signal when the housing is moved relative to an externally located magnet.

20. The device of claim 1 wherein the security sensor circuit comprises a gravitational field sensor for generating the alarm signal when the housing is moved relative to the earth's gravitational field.

21. The device of claim 1 wherein the power source is a battery.

22. The device of claim 1 wherein the power source is a piezoelectric element.

23. The device of claim 1 wherein the power source is a solar cell.

24. The device of claim 1 wherein the power source is a fuel cell.

25. A method of installing a wireless security device comprising the steps of:

a. providing a housing suitable for being embedded within a structure comprising:
   i. a security sensor circuit adapted to generate an alarm signal when activated;
   ii. a radio frequency transmitter connected to the security sensor circuit for transmitting a radio frequency signal when the alarm signal is generated; and
   iii. a power source for supplying operating power to the security sensor circuit and the radio frequency transmitter;

b. embedding the housing within a recess of a structure; and c. locating, on the surface of the structure in proximity to the housing, a substantially flat surface mountable strip comprising an antenna coupled to the radio frequency transmitter for emitting electromagnetic energy corresponding to the radio frequency signal.

26. The method of claim 25 wherein the antenna is coupled to the radio frequency transmitter by a wired connection.

27. The method of claim 25 wherein the antenna is coupled to the radio frequency transmitter by electromagnetic energy.

28. The method of claim 25 wherein the surface mountable strip is integrally attached to the housing to form a unitary component, whereby when the housing is recessed within a structure, the surface mountable strip is mounted along the surface of the structure.

29. The method of claim 28 wherein the housing is an embedded cylinder.

30. The method of claim 29 wherein the surface mountable strip is substantially circular in shape and has a diameter larger than the diameter of the cylinder.

31. The method of claim 29 wherein the surface mountable strip is substantially rectangular in shape and has an area larger than the area formed by the top of the cylinder.

32. The method of claim 25 wherein the surface mountable strip is plastic.

33. The method of claim 32 wherein the antenna is injection molded into the surface mountable strip.

34. The method of claim 25 wherein the antenna is formed of conductive ink printed onto the surface mountable strip.

35. The method of claim 34 further comprising the step of providing a transfer coil for transducing the radio frequency signal from the radio frequency transmitter to the antenna.

36. The method of claim 25 wherein the security sensor circuit, the radio frequency transmitter, and the power source are located in substantial isolation from the antenna.

37. The method of claim 25 wherein the housing comprises a printed circuit board, and wherein the radio frequency transmitter is mounted on the printed circuit board.

38. The method of claim 37 wherein the security sensor circuit is mounted on the printed circuit board.

39. The method of claim 25 wherein the security sensor circuit comprises a tilt switch for generating the alarm signal when the housing is moved.

40. The method of claim 25 wherein the security sensor circuit comprises a magnetic field sensor for generating the alarm signal when the housing is moved relative to the earth's magnetic field.

41. The method of claim 25 wherein the security sensor circuit comprises a magnetic field sensor for generating the alarm signal when the housing is moved relative to an externally located magnet.

42. The method of claim 25 wherein the security sensor circuit comprises a gravitational field sensor for generating the alarm signal when the housing is moved relative to the earth's gravitational field.

43. The method of claim 25 wherein the power source is a battery.

44. The method of claim 25 wherein the power source is a piezoelectric element.

45. The method of claim 25 wherein the power source is a solar cell.

46. The method of claim 25 wherein the power source is a fuel cell.

* * * * *